United States Patent [19]

Edelson et al.

[11] 4,177,903

[45] Dec. 11, 1979

[54] PAINT BRUSH MERCHANDISING DISPLAY

[75] Inventors: Stanley Edelson, Searingtown; Samuel Feinberg, Long Beach, both of N.Y.

[73] Assignee: Amsterdam Brush Company, Amsterdam, N.Y.

[21] Appl. No.: 862,793

[22] Filed: Dec. 21, 1977

[51] Int. Cl.[2] ..... A47F 7/00

[52] U.S. Cl. ..... 211/49 D; 211/60 T; 211/89

[58] Field of Search ..... 211/60 T, 106, 49 R, 211/49 D, 65, 94, 162; 248/220.3, 220.4, 221.1, 221.2, 110, 37.3, 37.6

[56] References Cited

U.S. PATENT DOCUMENTS

| | | | |
|---|---|---|---|
| 2,032,631 | 3/1936 | Pushee | 211/65 |
| 2,130,197 | 9/1938 | Schick | 211/65 X |
| 2,251,119 | 7/1941 | Currie | 211/65 |
| 2,284,452 | 5/1942 | Simons | 211/65 |
| 2,774,481 | 12/1956 | Sievers et al. | 211/89 |
| 3,152,697 | 10/1964 | Berman et al. | 211/49 D |
| 3,659,722 | 5/1972 | Carroll | 211/106 |
| 3,744,866 | 7/1973 | Cook | 211/49 D X |
| 3,976,201 | 8/1976 | Hodgson et al. | 248/220.4 X |
| 3,993,196 | 11/1976 | Immordino | 211/49 D |
| 4,064,991 | 12/1977 | Swanson | 211/60 T X |

FOREIGN PATENT DOCUMENTS

| | | | |
|---|---|---|---|
| 1340938 | 9/1963 | France | 211/49 D |

*Primary Examiner*—Roy D. Frazier
*Assistant Examiner*—Robert W. Gibson, Jr.
*Attorney, Agent, or Firm*—Alan H. Levine

[57] ABSTRACT

A paint brush merchandising display including a module having two vertical side walls, a back wall, and a forwardly and downwardly inclined bottom wall which extends beyond the front edges of the side walls. The side walls accommodate between them the handles of a stack of paint brushes, the wider bristle part of each paint brush being forwardly of the side walls. Strips of resilient material, such as foamed plastic, project into the space between the side walls to frictionally grip the paint brush handles. The module carries either a bottom bracket for mounting it on a shelf, or hook-like elements on its back wall for engagement over horizontal support bars. The support bars support the module so that it inclines downwardly and rearwardly. The support bars may be mounted on a pegboard.

6 Claims, 4 Drawing Figures

PAINT BRUSH MERCHANDISING DISPLAY

This invention relates to point-of-purchase merchandising displays, and more particularly to a display especially designed for holding stacks of paint brushes.

At the present time, paint brushes are most usually displayed in stores by hanging them from rods which pass through a hole in each paint brush handle. Several paint brushes can be suspended one behind the other from a single rod which projects horizontally from a support surface. An advantage of hanging paint brushes vertically in this way is that a broad face of the brush, or if the brush is within a package a broad face of the package, is exposed to the shopper so that the size of the brush and the copy on the package is easily viewed by the shopper. A disadvantage of this conventional display technique is that it uses space inefficiently. In any unit amount of vertical space, only a limited number of brushes can be displayed one above another when they are hung vertically, particularly in the case of larger size brushes. In addition, when brushes having different lengths are suspended vertically in side-by-side relation, the display space below the shorter brushes tends to be wasted, or necessitates a disorderly looking arrangement of brushes.

It is an object of the present invention to overcome these problems by providing a merchandising display which permits stacks of paint brushes of various sizes to be arranged side-by side in an orderly attractive manner without any waste of display space.

It is another object of the invention to provide such a display in which the stacks of paint brushes and/or each paint brush in the stack is inclined downwardly and forwardly so that a broad face of the uppermost brush, or of the package of the uppermost brush, is easily visible to a shopper.

It is a further object of the invention to provide such a display including one or more modules each holding a single stack of paint brushes, a single size module being used for a variety of different size brushes.

It is an additional object of the invention to provide a module which retains the brushes and/or the stack inclined forwardly and downwardly, and retains the brushes in place by a resilient frictional gripping force which can easily be overcome by a shopper when pulling a paint brush from the stack.

It is another object of the invention to provide such a module which can be mounted on an existing shelf, or on a support arrangement specially provided for supporting a plurality of the modules.

Additional objects and features of the invention will be apparent from the following description in which reference is made to the accompanying drawings.

Figure 1:
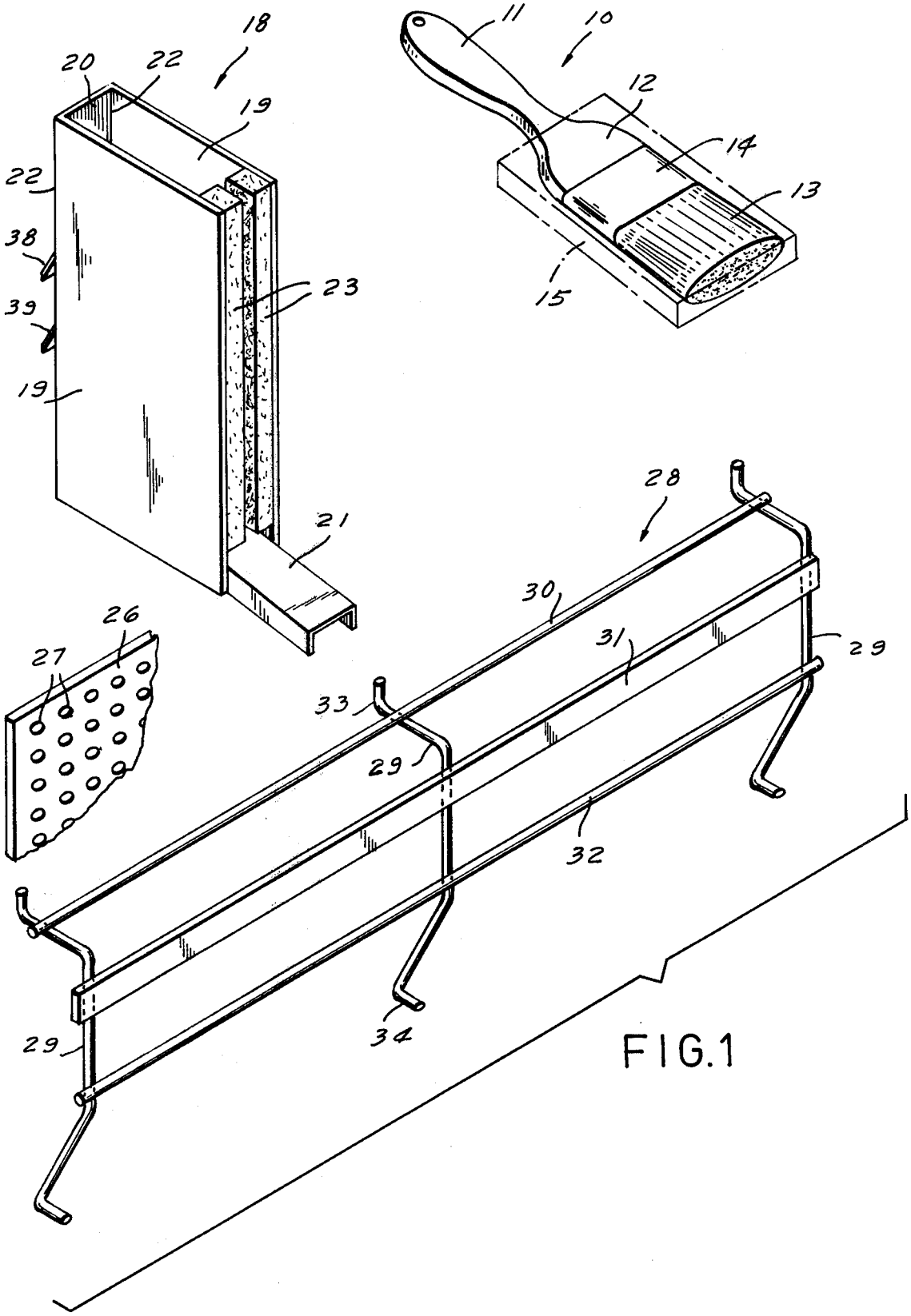
FIG. 1 is an exploded perspective view of the elements of a paint brush merchandising display according to this invention.
Figure 2:
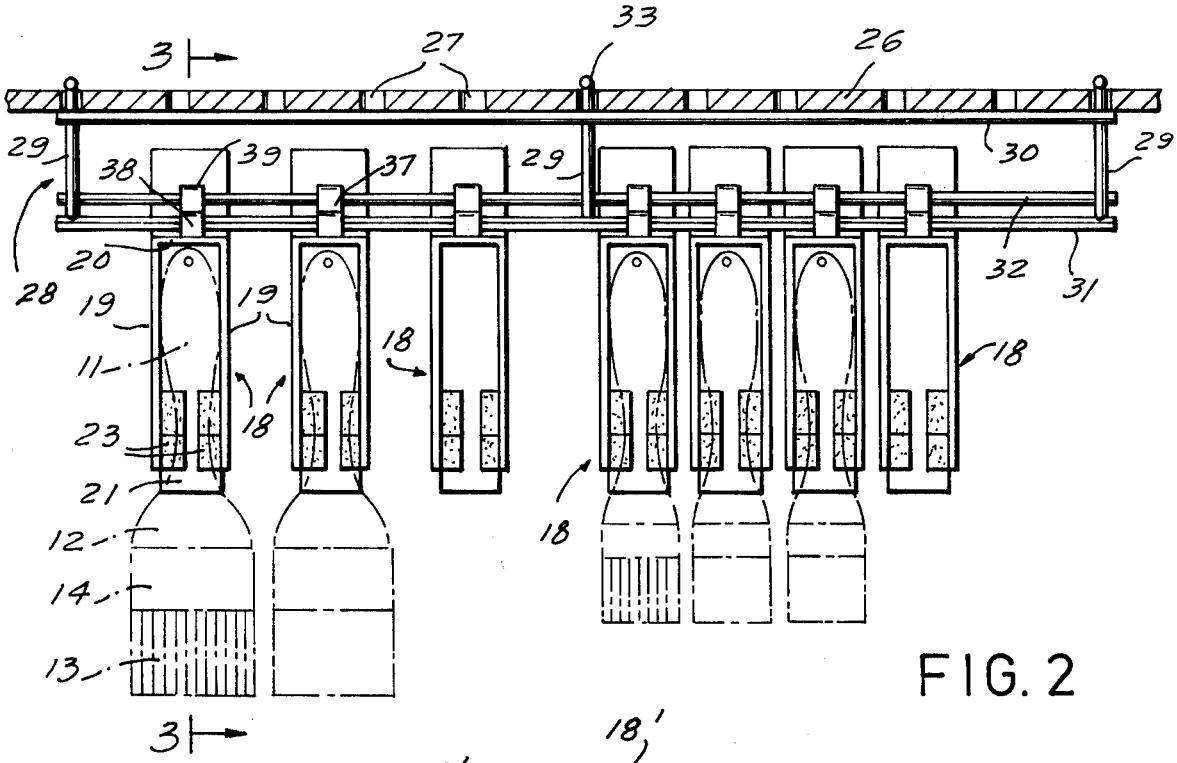
FIG. 2 is a top plan view of the display, showing a pegboard panel in cross-section.

The paint brush merchandising display of the present invention is for use with conventional paint brushes 10 of the type illustrated in FIGS. 1 and 2. The brush includes a relatively narrow handle 11 merging into a wide flat head 12. A bundle of bristles 13 is joined to head 12 by a band or ferrule 14. The head 12, bristles 13, and ferrule 14 are all of substantially the same width and constitute the widest part of the brush. In some cases, the head, bristles, and ferrule are enclosed within a package 15, which may be made of printed cardboard.

Figure 3:
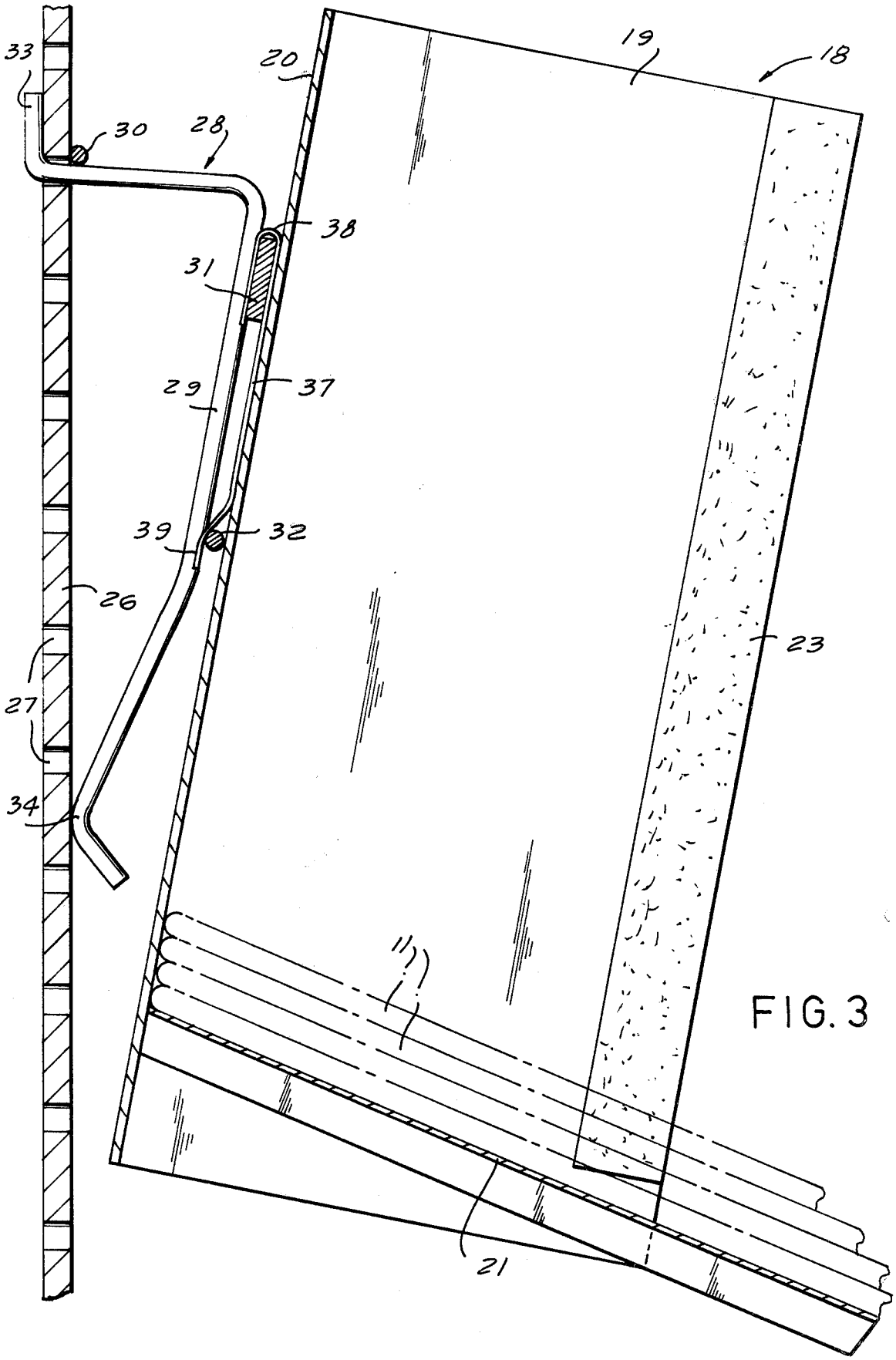
FIG. 3 is a vertical cross-sectional view taken on line 3—3 of FIG. 2.

The display chosen to illustrate the present invention, and shown in FIGS. 1–3, includes a module 18 having two rectangular vertical side walls 19 joined along their rear edges by a back wall 20. Walls 19 and 20 may be formed from a single piece of sheet metal bent at right angles along two parallel lines 22. Between side walls 19 is an inverted channel-shaped bottom wall 21 joined to the side walls in any suitable manner, such as by welding. Bottom wall 21 inclines downwardly and forwardly, as best seen in FIG. 3, and extends beyond the front edges of side walls 19. A narrow strip of resilient material 23, such as a plastic foam, is secured as by an adhesive to the inner face of each side wall 19 and along the front edge thereof.

In use, a stack of paint brushes 10 is held within the module 18, as indicated in FIGS. 2 and 3. Only the relatively narrow handles 11 of the paint brushes are located between side walls 19, and hence the side walls are horizontally spaced apart the smallest distance required to accommodate the widest handles of any paint brushes with which the display will be filled. The heads 12, bristles 13, and ferrules 14 of the stack of brushes are all located in front of side walls 19 and are supported by the portion of bottom wall 21 extending forwardly beyond the side walls.

As a result of the inclined nature of bottom wall 21, each paint brush 10 in the stack is simularly inclined; consequently, the broad face of brush parts 12–14, or of package 15 if one is used, is more exposed to the shopper than if the brushes were stacked horizontally, in which case only the end edges of the brushes or package would directly face the customer. Resilient strips 23 resiliently and frictionally grip each brush handle 11 between them and prevent the inclined brushes from sliding out of module 18. However, the grip of strips 23 is not so great as to prevent a brush from being pulled forwardly out of the module.

In the example of the invention shown in FIGS. 1–3, a plurality of modules 18 are mounted on a conventional pegboard panel 26 having the usual horizontal and vertical pattern of holes 27. Panel 26 may be mounted on a wall or may form part of a free standing display. Mounting of the modules is accomplished by means of a support bracket 28 comprising three uprights 29, formed of rigid bent wire to which are permanently joined, as by welding, three horizontal members, namely, a rod 30, a bar 31, and a rod or bar 32. The upper end 33 of each upright is bent such that when ends 33 are passed through holes 27 in pegboard 26, the pegboard is grasped between ends 33 and rod 30, to hold bracket 28 in place. The lower end portions 34 of each upright 29 rests against the front face of the pegboard.

Secured as by welding to the rear face of back wall 20 of module 18 is a bracket 37, made for example of sheet metal. The upper end of bracket 37 is bent to define a hook-like member 38, and the lower end of the bracket is bent to define a hook-like member 39. Hook members 38 and 39 are adapted to be engaged over bar 31 and rod 32, respectively to attach module 18 to bracket 28. It will be appreciated that in this way each module may be mounted at any desired point along the lengths of bar 31 and rod 32. Consequently, when brushes having relatively wide parts 12–14 are stacked in adjacent modules 18, the modules are spaced relatively far apart, as shown at the left in FIG. 2. On the other hand, when narrower brushes are stacked in adjacent modules, the modules are spaced closer together, as shown at the right in FIG. 2. Furthermore, stacks of brushes high enough to completely fill each module may be employed. Thus, no space need be wasted no matter what the width or length of the brushes being displayed.

The shape of uprights 29 is such that bar 31 and rod 32 are located in a plane which is inclined upwardly and forwardly, as shown in FIG. 3. As a result, the entire stack of brushes in each module is similarly inclined, the reason for this being to augment the benefit described above which is derived from inclining bottom wall 21, i.e., make the broad face of the uppermost brush or package more readily seen by a shopper.

Figure 4:
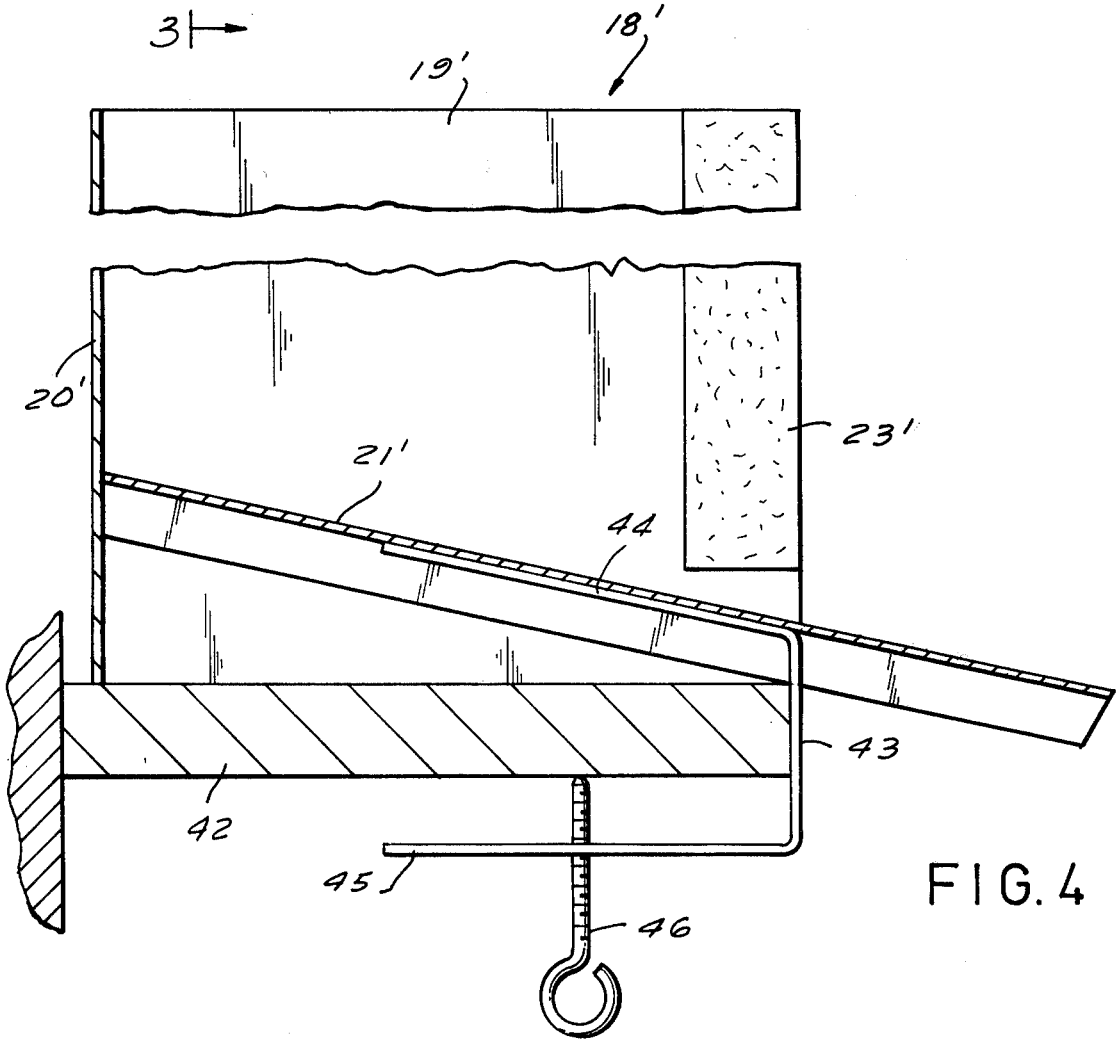
FIG. 4 is a fragmentary view similar to FIG. 3 showing another embodiment of the invention.

Modules 18 need not necessarily be supported on a pegboard 26 bracket 28 arrangement as described above. Instead, they may be adapted to be mounted on an existing store shelf 42 as shown in FIG. 4. In FIG. 4, parts similar to the parts of FIGS. 1–3 bear the same reference numerals followed by a prime. In this case, bracket 37 is not needed although it may be provided. Instead, a bracket 43, which may be a bent piece of sheet metal, is employed, the upper arm 44 of the bracket being fixed as by welding to the lower face of bottom wall 21. Lower arm 45 is spaced vertically from arm 44 so that the front edge of shelf 42 can be inserted between the arms. A thumb screw 46, threaded through a hole in arm 45 is used to hold module 18' in place on the shelf. In this embodiment, the modules are also spaced apart distances depending upon the width of the brushes held in them, so that no space along the length of shelf 42 is wasted.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

What is claimed is:

1. A modular merchandising display for paint brushes having a variety of sizes, the display comprising:

I. at least several modules all of which are identical to each other, each module being adapted to hold a stack of paint brushes and including:

(a) two vertical side walls permanently joined together at a fixed horizontal spacing, the spacing being larger than the width of the handles of a variety of sizes of paint brushes but smaller than the width of the bristle portions of the variety of sizes of paint brushes, (b) a bottom wall, between said side walls near the lower edges of the latter, for supporting the lowermost paint brush in a stack between said side walls, said bottom wall extending forwardly beyond the front edges of said side walls and being inclined downwardly from back to front, (c) a strip of resilient material carried by each side wall along its front edge, said strips projecting toward each other and being spaced apart a distance smaller than the width of a paint brush handle so that they frictionally grip between them the handles of a stack of paint brushes between said walls, the compressability of said strips permitting each paint brush handle to move outwardly between the strips when a paint brush is removed from the module, II. a horizontally elongated support having a length many times the width of one of said modules, and III. mounting means carried by each of said modules and projecting beyond the external contours of its respective module for securing the module to said support at any point along the length of said support, whereby said modules may be mounted with any desired spacing between them.

2. A paint brush merchandising display as defined in claim 1 wherein said mounting means includes a bracket fixed to and projecting downwardly from said bottom wall for securing said module to a horizontal shelf.

3. A paint brush merchandising display as defined in claim 1 wherein said mounting means includes hook-like means projecting rearwardly from said back wall.

4. A paint brush merchandising display as defined in claim 1 wherein said support comprises a horizontal bar, and including hook-like mounting means projecting rearwardly from the back wall of each of said modules for engagement over said bar at any desired point along the length of said bar, whereby said modules may be spaced closer together or farther apart as desired.

5. A paint brush merchandising display as defined in claim 4 wherein said support includes at least two vertically spaced apart horizontal bars, and said hook-like mounting means cooperates with both of said bars to hold each of said modules so that it is inclined rearwardly from top to bottom so that the stack of brushes between said side walls is similarly inclined.

6. A paint brush merchandising display as defined in claim 5 wherein said support includes a vertical pegboard, and means for mounting said bars on sad pegboard with said bars spaced in front of said pegboard.

* * * * *